US009064665B2

(12) United States Patent
Li et al.

(10) Patent No.: US 9,064,665 B2
(45) Date of Patent: Jun. 23, 2015

(54) ELECTROMAGNETIC RELAY

(71) Applicant: FUJITSU COMPONENT LIMITED, Tokyo (JP)

(72) Inventors: Ying Li, Tokyo (JP); Satoshi Takano, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/068,689

(22) Filed: Oct. 31, 2013

(65) Prior Publication Data

US 2014/0203898 A1 Jul. 24, 2014

(30) Foreign Application Priority Data

Jan. 21, 2013 (JP) ..... 2013-008531

(51) Int. Cl.

| | |
|---|---|
| ***H01H 51/22*** | (2006.01) |
| ***H01H 67/02*** | (2006.01) |
| ***H01H 50/64*** | (2006.01) |
| ***H01H 50/04*** | (2006.01) |

(52) U.S. Cl.

CPC ..... *H01H 50/641* (2013.01); *H01H 50/042* (2013.01); *H01H 50/642* (2013.01); *H01H 2050/046* (2013.01)

(58) Field of Classification Search

CPC ..... H01H 50/642
USPC ..... 335/129, 78
See application file for complete search history.

(56) References Cited

U.S. PATENT DOCUMENTS

| | | | | |
|---|---|---|---|---|
| 5,969,586 | A | 10/1999 | Noda et al. | |
| 6,940,375 | B2 * | 9/2005 | Sanada et al. | 335/86 |
| 6,995,639 | B2 * | 2/2006 | Minowa et al. | 335/83 |
| 7,157,994 | B2 * | 1/2007 | Minowa et al. | 335/84 |
| 7,205,870 | B2 * | 4/2007 | Sanada et al. | 335/78 |
| 8,111,117 | B2 * | 2/2012 | Minowa et al. | 335/78 |
| 2002/0050883 | A1 | 5/2002 | Miyazaki et al. | |
| 2002/0130741 | A1 | 9/2002 | Noguchi | |

(Continued)

FOREIGN PATENT DOCUMENTS

| | | |
|---|---|---|
| CZ | 1999-4377 | 12/2000 |
| EP | 1420428 A1 | 5/2004 |
| JP | 63-47000 | 12/1988 |

(Continued)

OTHER PUBLICATIONS

Extended European Search Report dated May 15, 2014 in corresponding European Patent Application No. 14151276.4.

*Primary Examiner* — Alexander Talpalatski
(74) *Attorney, Agent, or Firm* — Staas & Halsey LLP

(57) ABSTRACT

An electromagnetic relay is provided with an armature which is pulled by an electromagnet and a card which transmits operation of the armature to the moving electrode plate. The armature includes an engagement part which engages with the card. The card includes a pedestal part which extends from the card body, a deforming part which extends from the card body and can elastically deform, and a tab which sticks out toward the pedestal part. The deforming part has a first part which extends from the card body and a second part which extends bent from the first part. The engagement part is sandwiched between the pedestal part and the second part. The ends in the width direction of the surface which the tab contacts when the engagement part is pushed between the pedestal part and the tab are formed with inclined parts.

4 Claims, 7 Drawing Sheets

(56) References Cited

U.S. PATENT DOCUMENTS

| | | | | |
|---|---|---|---|---|
| 2004/0113729 | A1* | 6/2004 | Sanada et al. | 335/129 |
| 2004/0130419 | A1* | 7/2004 | Sanada et al. | 335/129 |

FOREIGN PATENT DOCUMENTS

| | | |
|---|---|---|
| JP | 7-312161 | 11/1995 |
| JP | 9-245599 | 9/1997 |

* cited by examiner

ELECTROMAGNETIC RELAY

CROSS-REFERENCE TO RELATED APPLICATIONS

This application is based upon and claims the benefit of priority of the prior Japanese Patent Application No. 2013-008531, filed Jan. 21, 2013, the entire contents of which are incorporated herein by reference.

BACKGROUND OF THE INVENTION

1. Field of the Invention

The present invention relates to an electromagnetic relay.

2. Description of the Related Art

As a device which is arranged in an electrical circuit to electrically connect and disconnect it, an electromagnetic relay is known. An electromagnetic relay is provided with an electromagnet which includes a coil, an armature which faces the electromagnet, and electrodes which are connected to the armature and include contacts. In the electromagnetic relay, when the coil is energized, the armature is pulled by the electromagnet causing the armature to move. Due to movement of the armature, a plurality of contacts are electrically contacted or separated.

Japanese Patent Publication No. 7-312161 discloses an electromagnet which is provided with a coil block, a plate shaped yoke which is fastened by being inserted between magnetic poles of the coil block and which forms a magnetic circuit with the iron core, and a block shaped permanent magnet which is provided at the center part of the plate shaped yoke. It is disclosed that the armature of the electromagnet is formed with a hole part, cutaway part, and recess part as parts for adjusting the magnetic resistance.

Japanese Examined Utility Model Publication No. 63-47000B2 discloses an electromagnet relay which fastens a spring component which includes a fixed contact spring and a moving contact spring integrally to an electromagnet component. In this electromagnetic relay, it is disclosed that a hole which is provided at a free end of the moving spring and a hole which is provided at a front end of the armature are connected by a drive card.

Japanese Patent Publication No. 9-245599A discloses an electromagnetic relay in which a coil block and contact operating mechanism are arranged separated on a base member and in which a moving piece which is attached to the coil block and the contact operating mechanism which includes electrodes having contacts are connected by a card. It is disclosed that the card of this electromagnetic relay has a bottom end which is locked with a lock hole of a moving contact piece and has a top end with a lock recess in which a lock projection which is formed on the moving iron piece is locked.

As disclosed in the above patent literature, it is known to arrange a card between an armature and electrodes to transmit the operation of the armature to the electrodes in the electromagnetic relay. The electromagnetic relay which is provided with the card is formed so that the card moves corresponding to the operation of the armature and the electrodes move corresponding to the operation of the card. The armature is formed by iron etc. since it is formed by for example a magnetic body. As opposed to this, the card is formed by an insulating material of resin etc.

In the production of an electromagnetic relay, the card has to be connected to the armature, but in the process of connecting the card to the armature, sometimes part of the card is scraped off. For example, sometimes the connecting part of a card is fit into a connecting part of an armature. The armature is formed by iron or another hard material, while the card is formed by resin or other soft material, so when fitting the card in the armature, sometimes the part of the card which slides against the armature is scraped off and scrapings are produced.

After assembling the electromagnet or the card or other inside parts, the inside parts are covered by a case. In this regard, the scrapings of the card sometimes remain in the case. If the scrapings of the card remain inside the case, for example, they sometimes stick to the contacts and cause poor connection between the contacts.

Further, an armature is sometimes formed with a narrow part for fitting the card. In this regard, sometimes the strength of the part for fitting the card is insufficient and the part for fitting the card deforms in the production of the armature. If the part for fitting the card was not formed to the desired shape, the armature is treated as defective.

SUMMARY OF THE INVENTION

The present invention has as its object the provision of an electromagnetic relay which suppresses defects in the process of production.

A first electromagnetic relay of the present invention is provided with an electromagnet which includes a coil, an armature which is pulled by the electromagnet, a moving member which has a moving contact, and a connecting member which engages with the armature and the moving member and transmits the operation of the armature to the moving member. The armature includes an armature body and an engagement part which engages with the connecting member, while the connecting member includes a connecting member body, a pedestal part which extends from the connecting member body, a deforming part which extends from the connecting member body and can elastically deform, and a tab which is formed at the end of the deforming part and sticks out toward the pedestal part. The deforming part has a first part which extends from the connecting member body and a second part which extends bent from the first part and deforms when the engagement part is pushed between the pedestal part and the tab. The engagement part is sandwiched between the pedestal part and second part when the engagement part engages with the connecting member. A chamfered part where an angular part is chamfered is formed at the end of a surface in the width direction which the tab contacts when the engagement part is pushed between the pedestal part and the tab.

A second electromagnetic relay of the present invention is provided with an electromagnet which includes a coil, an armature which is pulled by the electromagnet, a moving member which has a moving contact, and a connecting member which engages with the armature and the moving member and transmits operation of the armature to the moving member. The armature includes an armature body and an engagement part which engages with the connecting member, while the connecting member includes a connecting member body, a pedestal part which extends from the connecting member body, a deforming part which extends from the connecting member body and can elastically deform, and a tab which is formed at the end of the deforming part and sticks out toward the pedestal part. The deforming part has a first part which extends from the connecting member body and a second part which extends bent from the first part and deforms when the engagement part is pushed between the pedestal part and the tab. The engagement part is sandwiched between the pedestal part and the second part when the engagement part engages with the connecting member, and is configured by a part which is sandwiched between a cutaway part which is formed at one end of the armature in the width direction and a recess part which is formed at the other end in the width direction.

DESCRIPTION OF EMBODIMENTS

Referring to FIG. 1 to FIG. 16, an electromagnetic relay will be explained.

Figure 1:
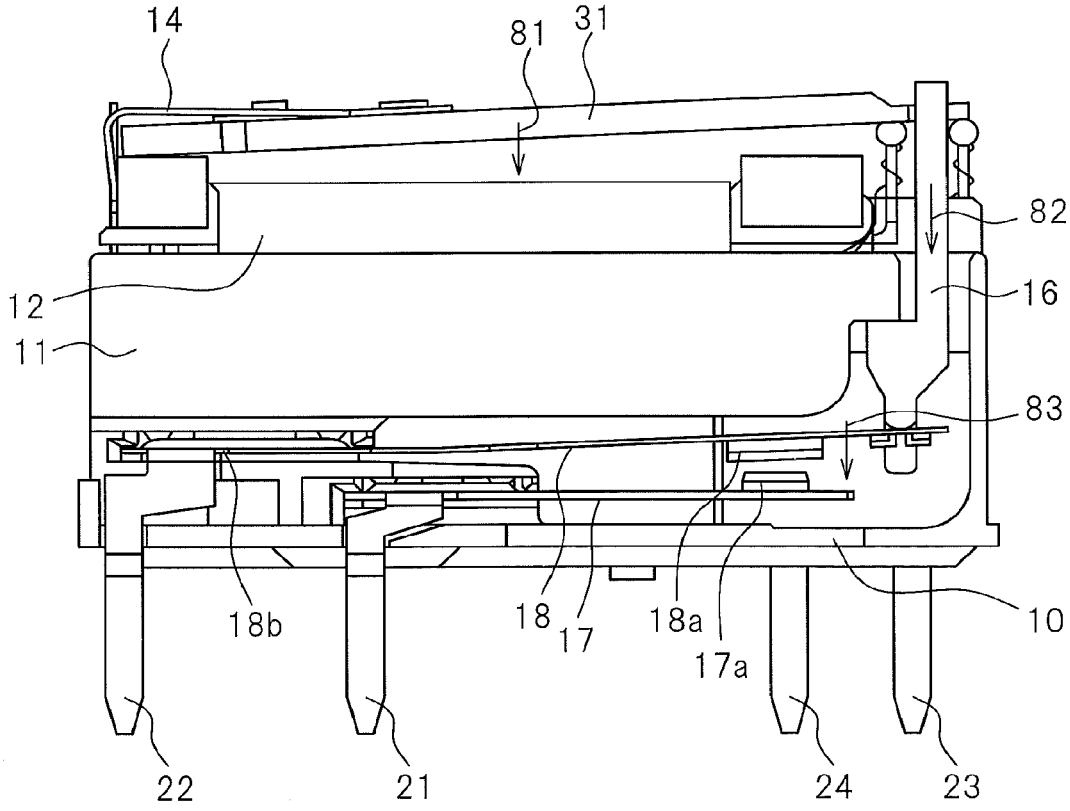
FIG. 1 is a schematic front view when detaching a case in an electromagnetic relay of an embodiment.

FIG. 1 is a front view of the electromagnetic relay of the present embodiment when detaching a case covering an electromagnet and other internal parts.

The electromagnetic relay of the present embodiment is provided with an electromagnet 12. In the present embodiment, the electromagnet 12 comprises a coil and an iron core which are covered by resin. The electromagnet 12 generates magnetic force when the coil is energized, that is, the electromagnet 12 is excited. The electromagnet 12 stops generating a magnetic force when energization of the coil is stopped.

The electromagnetic relay of the present embodiment is provided with a base member 10. In the present embodiment, the base member 10 is formed by resin which has an electrical insulating property. The base member 10 includes a support part 11. The electromagnet 12 is placed on the base member 10 and is supported by the support part 11. The coil inside of the electromagnet 12 is connected to coil terminals 23 and 24.

The electromagnetic relay has an armature 31 which is pulled by the electromagnet 12. The armature 31 is formed into a plate shape from a magnetic material. The armature 31 of the present embodiment is formed from iron. The armature 31 has one end fastened to a flat spring 14. The flat spring 14 is fastened to the base member 10. The flat spring 14 has elasticity and is formed so as to bias the armature 31 in a direction away from the electromagnet 12.

The electromagnetic relay is provided with a moving electrode plate 18 as a moving member which has a moving contact 18*a*. The moving electrode plate 18 is formed into a plate shape and has elasticity. The moving electrode plate 18 has one end 18*b* which is fastened to the base member 10. The moving electrode plate 18 is formed by a material which has electrical conductivity. The moving electrode plate 18 is connected to a contact terminal 22. The contact terminal 22 is connected to an external electrical circuit.

The electromagnetic relay includes a fixed electrode plate 17 as a fixed member which has a fixed contact 17*a*. The fixed electrode plate 17 is formed into a plate shape. The fixed electrode plate 17 is arranged so as to face the moving electrode plate 18. The fixed electrode plate 17 is fixed to the base member 10. The moving contact 18*a* and the fixed contact 17*a* are arranged so as to face each other. The fixed electrode plate 17 is formed by a material which has electrical conductivity. The fixed electrode plate 17 is connected to a contact terminal 21. The contact terminal 21 is connected to an external electrical circuit.

The electromagnetic relay is provided with a card 16 as a connecting member which transmits the operation of the armature 31 to the moving electrode plate 18. The card 16 is connected to the other end of the armature 31 at the opposite side to the one end where the flat spring 14 is arranged. The card 16 engages with the armature 31 and the moving electrode plate 18. The card 16 is formed to be able to move in the direction which is shown by the arrow 82 and in the direction opposite to the direction which is shown by the arrow 82. The card 16 transmits the operation of the other end of the armature 31 to the moving electrode plate 18.

When the coil of the electromagnet 12 is not being energized, the armature 31 separates from the electromagnet 12 due to the biasing force of the flat spring 14. At this time, the moving electrode plate 18 is in a state separated from the fixed electrode plate 17. The moving contact 18*a* is separated from the fixed contact 17*a* and electrically disconnected.

When energizing the coil of the electromagnet 12, a magnetic field is generated around the core of the electromagnet 12 and the armature 31 is pulled to the electromagnet 12 as shown by the arrow 81. The other end of the armature 31 pushes the card 16, whereby the card 16 moves in the direction which is shown by the arrow 82 and the end of the moving electrode plate 18 is pushed. When the moving electrode plate 18 is pushed by the card 16, the moving electrode plate 18 bends toward the fixed electrode plate 17 as shown by the arrow 83. The moving contact 18*a* moves toward the fixed contact 17*a* and contacts the fixed contact 17*a*. As a result, electrical conduction is achieved.

If stopping the energization of the coil of the electromagnet 12, the elastic force of the flat spring 14 causes the armature 31 to move in a direction away from the electromagnet 12. The other end of the armature 31 is lifted up, then the card 16 moves in a direction opposite to the arrow 82. The moving contact 18*a* separates from the fixed contact 17*a* and is electrically disconnected. The electromagnetic relay of the present embodiment can energize and deenergize the coil 2 so as to make the fixed contact 17*a* and the moving contact 18*a* contact and separate from each other.

Figure 2:
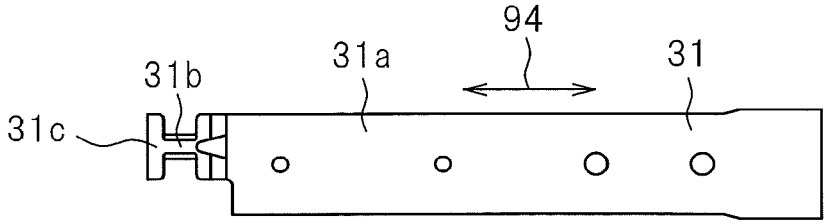
FIG. 2 is a plan view of an armature according to a first example of the embodiment.

FIG. 2 is a plan view of an armature 31 according to a first example of the present embodiment. In the first example, the armature 31 has an armature body 31*a*, an engagement part 31*b* which is connected to the armature body 31*a*, and a guide part 31*c* which is connected to the engagement part 31*b*. In the armature 31, the direction which is shown by the arrow 94 is defined as the longitudinal direction, while the direction which is perpendicular to the longitudinal direction is defined as the width direction. In the longitudinal direction of the armature body 31*a*, the engagement part 31*b* and the guide part 31*c* are formed at the other end at the opposite side to one end where the flat spring 14 is fixed. The armature of the present embodiment is formed from a single member. The armature body 31*a*, engagement part 31*b*, and guide part 31*c* are integrally formed.

Figure 3:
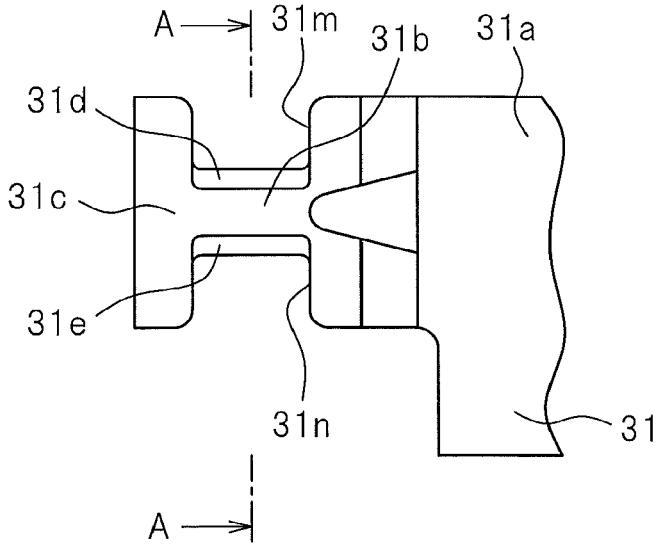
FIG. 3 is an enlarged plan view of a part of an engagement part of the armature according to the first example of the embodiment.
Figure 4:
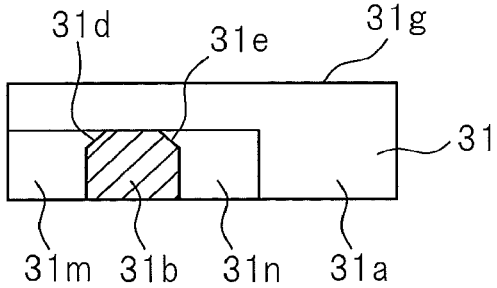
FIG. 4 is a schematic cross-sectional view when cut at the part of an engagement part of the armature according to the first example of the embodiment.

FIG. 3 is an enlarged plan view of part of the engagement part 31*b* of the armature 31 according to the first example of the present embodiment. FIG. 4 is a cross-sectional view when cutting the engagement part 31*b* of the armature 31 according to the first example of the present embodiment along the line A-A of FIG. 3. Referring to FIG. 2 to FIG. 4, the engagement part 31*b* is formed to become smaller in width than the armature body 31*a*. At the both sides of the engagement part 31*b* in the width direction, cutaway parts 31*m* and 31*n* are formed. The cutaway parts 31*m* and 31*n* have shapes formed by cutting away parts of the ends of the armature 31 at the both sides in the width direction. In this way, the engagement part 31*b* is configured by the part which is sandwiched between the cutaway parts 31*m* and 31*n*. The guide part 31*c* is formed so as to extend in the width direction of the armature 31 and functions to guide the card 16 to the engagement part 31*b* when fitting the card 16 into the engagement part 31*b*.

The engagement part 31*b* of the first example is formed to a substantially rectangular shape when cutting in the width direction. The engagement part 31*b* has inclined parts 31*d* and 31*e* as chamfered parts obtained by chamfering angular parts. The inclined parts 31*d* and 31*e* are formed at the ends of the surface of the engagement part 31*b* in the width direction which a tab 16*c* of the card 16 contacts when pushing the engagement part 31*b* into the part sandwiched between the tab 16*c* and a pedestal part 16*b* of the card 16. The surfaces of the inclined parts 31*d* and 31*e* are formed in flat shapes. The inclined parts 31*d* and 31*e* are formed to be inclined with respect to the surface 31*g* of the armature body 31*a*. The inclined parts 31*d* and 31*e* are formed at the ends of the engagement part 31*b* at the both sides in the width direction. Such cutaway parts 31*m* and 31*n* and inclined part 31*d* and 31*e* of the armature 31 can be formed by cutting or grinding a material forming the engagement part 31*b*.

Figure 5:
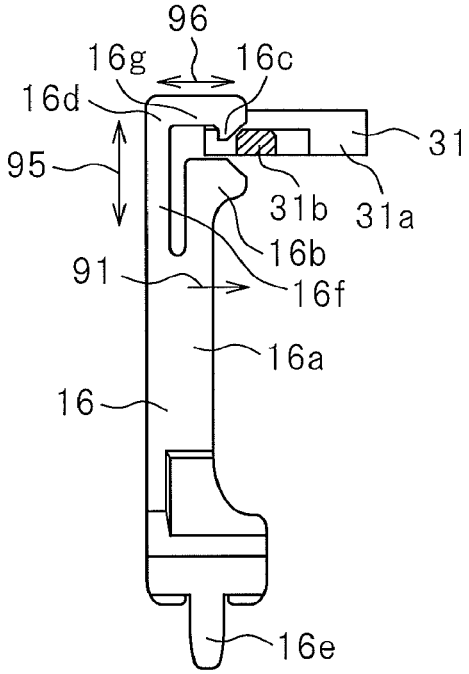
FIG. 5 is a schematic view which explains a first step when fitting a card in the armature according to the first example of the embodiment.

FIG. 5 is an explanatory view of a first step in the process of production of an electromagnetic relay of the present embodiment when fitting the card 16 in the armature 31. FIG. 5 is a view of the electromagnetic relay from the side. In the process of production, the card 16 is fit into the engagement part 31*b* of the armature 31 and the armature 31 and the card 16 are connected. Referring to FIG. 1 and FIG. 5, the card 16 of the present embodiment is formed in a plate shape. The card 16 is formed by a material which has an electrical insulating property. The card 16 of the present embodiment is formed from resin.

The card 16 includes a card body 16*a* as a connecting member body and an insertion part 16*e* which extends from the card body 16*a* and is inserted into the moving electrode plate 18. The insertion part 16*e* has the function of pushing the moving electrode plate 18. The card 16 includes a pedestal part 16*b* which extends from the card body 16*a* and forms a pedestal for the engagement part 31*b* of the armature 31. The card 16 includes a deforming part 16*d* which extends from the card body 16*a* and can elastically deform.

The deforming part 16*d* of the present embodiment has a first part 16*f* which extends from the card body 16*a* in the direction which is shown by the arrow 95 and a second part 16*g* which is bent from the first part 16*f* and extends in the direction which is shown by the arrow 96. In this way, the deforming part 16*d* has a bent shape when viewing the electromagnetic relay from the side. The front end of the deforming part 16*d* is formed with a tab 16*c*. The tab 16*c* is formed so as to face the pedestal part 16*b*. Furthermore, the tab 16*c* sticks out toward the pedestal part 16*b*. The distance between the pedestal part 16*b* and the tab 16*c* is made to be smaller than the thickness of the engagement part 31*b* of the armature 31.

When fitting the card 16 in the armature 31, the card 16 is moved so that the engagement part 31*b* of the armature 31 is arranged between the tab 16*c* and the pedestal part 16*b*. Next, as shown by the arrow 91, the card 16 is pushed into the armature 31. That is, the engagement part 31*b* is pushed into the part of the card 16 which is sandwiched between the pedestal part 16*b* and the tab 16*c*. At this time, the guide part 31*c* of the armature 31 keeps the card 16 from detaching from the engagement part 31*b*. For this reason, the card 16 can be easily made to move in the width direction of the engagement part 31*b*.

Figure 6:
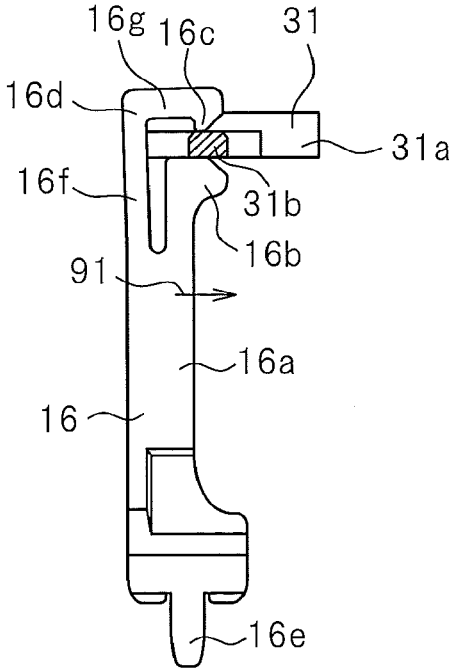
FIG. 6 is a schematic view which explains a second step when fitting a card in the armature according to the first example of the embodiment.

FIG. 6 is an explanatory view of a second step when fitting the card 16 in the armature 31. By pushing the card 16 into the armature 31, the deforming part 16*d* bends and the distance between the pedestal part 16*b* and the tab 16*c* becomes larger. The engagement part 31*b* slides with respect to the pedestal part 16*b* and tab 16*c*. The engagement part 31*b* enters between the pedestal part 16*b* and the tab 16*c*.

Figure 7:
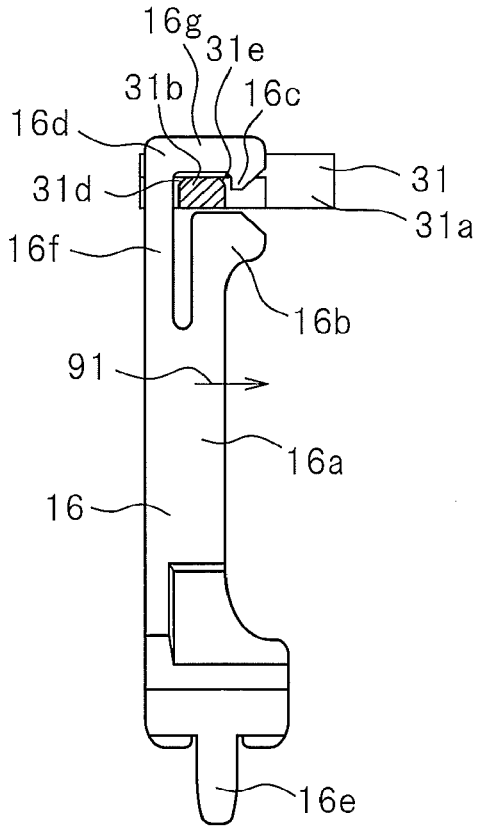
FIG. 7 is a schematic view which explains a third step when fitting a card in the armature according to the first example of the embodiment.

FIG. 7 is an explanatory view of a third step when fitting the card 16 in the armature 31. After the second step, the card 16 can be moved to a direction as shown by the arrow 91 to arrange the engagement part 31*b* in the space which is surrounded by the deforming part 16*d* and the pedestal part 16*b*. At this time, the deforming part 16*d* returns to its original shape. The engagement part 31*b* is sandwiched between the pedestal part 16*b* and the second part 16*g* of the deforming part 16*d*. In this way, the card 16 can be fit into the engagement part 31*b* of the armature 31. In the state where the card 16 and the armature 31 are connected, the engagement part 31*b* of the armature 31 is arranged in the space which is surrounded by the deforming part 16*d* and the pedestal part 16*b*.

Figure 8:
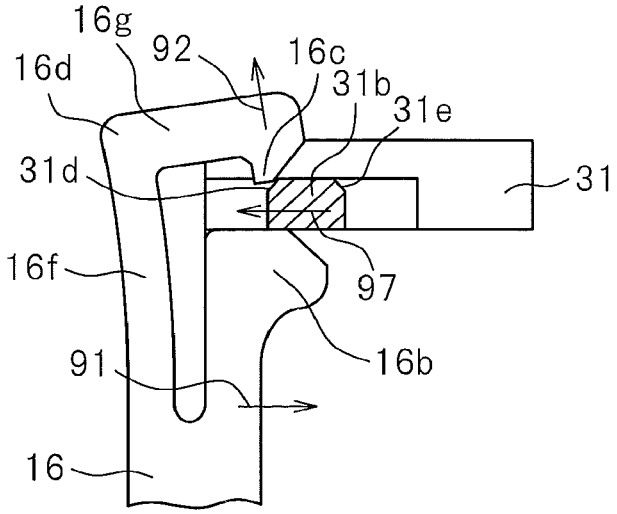
FIG. 8 is a cross-sectional view when a tab of a card abuts against one inclined part of an engagement part when fitting the card in the armature according to the first example of the embodiment.

FIG. 8 is a first enlarged cross-sectional view of part of the engagement part 31*b* when fitting the card 16 in the armature 31 according to the first example of the present embodiment. FIG. 8 shows the state where the tab 16*c* contacts the inclined part 31*d* of the engagement part 31*b*. The engagement part 31*b* of the armature 31 includes a surface at the side facing the pedestal part 16*b* and a surface at the side facing the tab 16*c*. The inclined parts 31*d* and 31*e* are formed at the end in the width direction of the surface of the engagement part 31*b* at the side which faces the tab 16*c*. The direction in which the engagement part 31*b* is inserted into the card 16 is shown by the arrow 97. The inclined parts 31*d* and 31*e* are inclined with respect to the direction of insertion into the card 16.

As explained above, when the card 16 is fit into the engagement part 31*b* of the armature 31, the card 16 is made to move in the state with the pedestal part 16*b* and the tab 16*c* made to contact the engagement part 31*b*. At this time, the deforming part 16*d* deforms and the tab 16*c* is lifted up as shown by the arrow 92. Due to the reaction force of the deforming part 16*d*, the tab 16*c* is pushed toward the inclined part 31*d*. The tab 16*c* of the present embodiment is formed by a material which is softer than the engagement part 31*b*. However, the tab 16*c* contacts the inclined part 31*d* and smoothly moves along the inclined part 31*d*. For this reason, even if the tab 16*c* presses against the engagement part 31*b*, the tab 16*c* can be kept from being scraped by the engagement part 31*b*.

Figure 9:
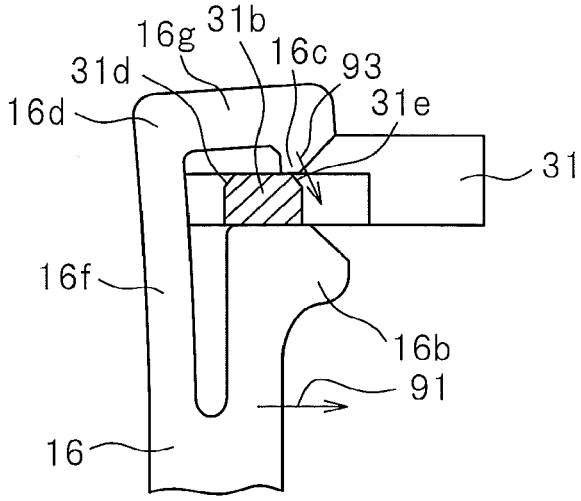
FIG. 9 is a cross-sectional view when a tab of a card abuts against another inclined part of an engagement part when fitting the card in the armature according to the first example of the embodiment.

FIG. 9 is a second enlarged cross-sectional view of part of the engagement part 31*b* when fitting the card 16 in the armature 31 according to the first example of the present embodiment. FIG. 9 shows the state where the tab 16*c* contacts the inclined part 31*e* of the engagement part 31*b*. If the tab 16*c* of the card 16 proceeds to the other end of the engagement part 31*b*, the tab 16*c* contacts the inclined part 31*e*. The tab 16*c* moves toward the original position as shown by the arrow 93. The tab 16*c* smoothly moves while contacting the inclined part 31*e* of the engagement part 31*b*. For this reason, the tab 16*c* can be kept from being scraped by the engagement part 31*b*.

Figure 10:
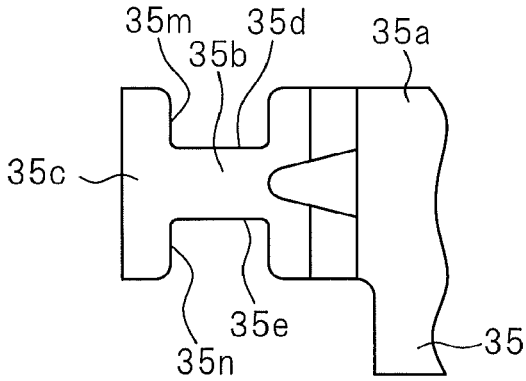
FIG. 10 is an enlarged plan view of an engagement part of an armature of a comparative example.
Figure 11:
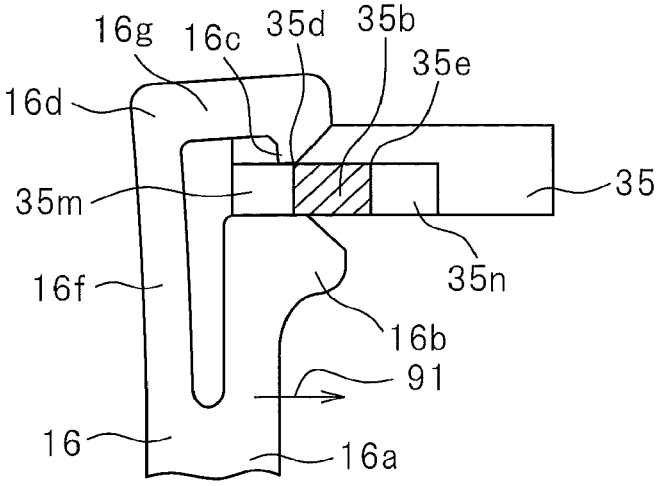
FIG. 11 is a cross-sectional view when inserting a card in the armature of the comparative example.

Here, an armature of a comparative example will be explained. FIG. 10 is an enlarged plan view of part of an engagement part 35*b* of an armature 35 of the comparative example. FIG. 11 is a cross-sectional view when fitting the card 16 in the armature 35 of the comparative example. The armature 35 of the comparative example includes an armature body 35*a*, an engagement part 35*b*, and a guide part 35*c*. The engagement part 35*b* has a configuration which is sandwiched between the cutaway parts 35*m* and 35*n*.

The engagement part 35*b* of the comparative example is not formed with chamfered parts at angular parts which the tab 16*c* of the card 16 contacts. That is, the engagement part 35*b* is not formed with inclined parts at the ends in the width direction but has sharp corner parts 35*d* and 35*e*. The engagement part 35*b* is formed to have a rectangular cross-sectional shape.

If the card 16 is made to move relative to the armature 35 of the comparative example as shown by the arrow 91, the tab 16*c* contacts one angular part 35*d* of the engagement part 35*b*. At this time, since the angular part 35*d* has a sharp shape and, furthermore, the engagement part 35*b* is formed by a material which is harder than the tab 16*c*, sometimes the tab 16*c* is scraped when the tab 16*c* slides against the angular part 35*d*. Furthermore, when the tab 16*c* contacts the angular part 35*e* by making the card 16 move as shown by the arrow 91, sometimes the tab 16*c* is scraped. In this way, in the armature 35 of the comparative example, when fitting the card 16 in the armature 35, the tab 16*c* may be scraped and scrapings are formed. Scrapings remaining inside the electromagnetic relay may cause poor connection between the contacts.

Referring to FIG. 8 and FIG. 9, as opposed to the comparative example, the armature 31 of the present embodiment is formed with inclined parts 31*d* and 31*e* obtained by chamfering the angular parts of the engagement part 31*b* at the ends of the surface in the width direction which the tab 16*c* contacts when the engagement part 31*b* is pushed between the pedestal part 16*b* and the tab 16*c*. For this reason, it is possible to keep the tab 16*c* from being scraped. It is possible to keep scrapings from being produced in the process of production of an electromagnetic relay and to keep scrapings from remaining inside the electromagnetic relay. As a result, it is possible to suppress defects in the electromagnetic relay.

Figure 12:
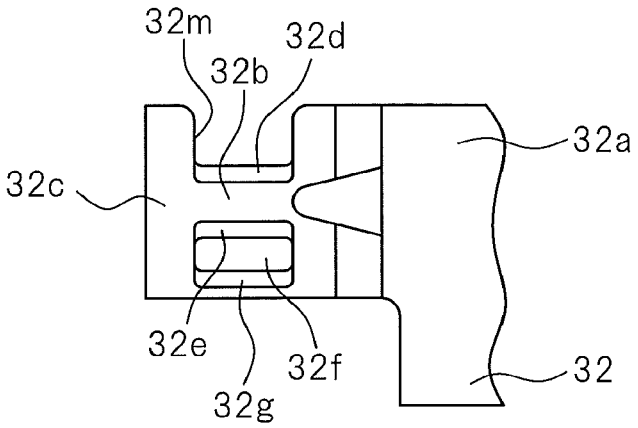
FIG. 12 is an enlarged plan view of a part of an engagement part of an armature according to a second example of the embodiment.
Figure 13:
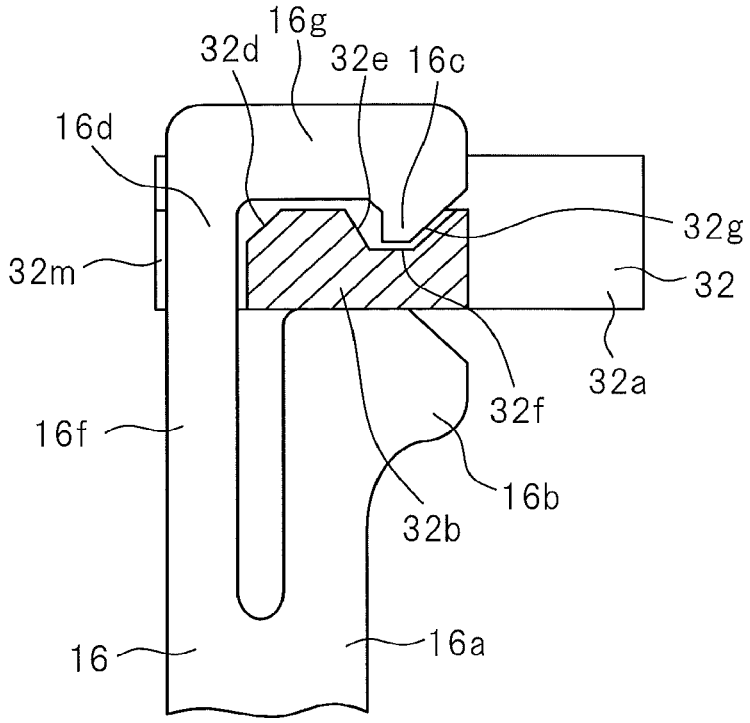
FIG. 13 is an enlarged cross-sectional view when fitting a card in the armature according to the second example of the embodiment.

FIG. 12 is an enlarged plan view of a part of an engagement part 32*b* of an armature 32 according to a second example of the present embodiment. FIG. 13 is a cross-sectional view when fitting the card 16 in the armature 32 according to the second example of the present embodiment. Referring to FIG. 12 and FIG. 13, the armature 32 includes an armature body 32*a*, an engagement part 32*b*, and a guide part 32*c*. The armature 32 is formed with a cutaway part 32*m* at one end in the width direction and is formed with a recess part 32*f* at the other end of the width direction. The recess part 32*f* is formed so as to be recessed from the surface of the engagement part 32*b*. The engagement part 32*b* is configured by a part which is sandwiched between the cutaway part 32*m* and the recess part 32*f*. At the surface which the tab 16*c* contacts when the engagement part 32*b* is pushed between the pedestal part 16*b* and the tab 16*c*, inclined parts 32*d* and 32*e* are formed at the ends at the both sides in the width direction.

The recess part 32*f* is formed so as to be able to hold the tab 16*c* inside it. Further, the recess part 32*f* has a depth giving a clearance between the tab 16*c* and the bottom surface of the recess part 32*f* when holding the tab 16*c*. At the ends of the recess part 32*f* at the both sides in the width direction, an inclined part 32*g* is formed in addition to the inclined part 32*e*. Such a recess part 32*f* can, for example, be formed by pressing the member forming the base material by a die. That is, it may be formed by press forming the base material. Alternatively, it may be formed by cutting the surface of a member forming the base material.

In the electromagnetic relay which is provided with an armature 32 as well, the ends of the engagement part 32*b* at the both sides in the width direction are formed with inclined parts 32*d* and 32*e*, so it is possible to keep the tab 16*c* of the card 16 from being scraped when fitting the card 16 into the armature 32. As a result, it is possible to keep scrapings from remaining inside of the electromagnetic relay.

Further, the armature 32 is formed with a recess part 32*f* at the other end in the width direction. The armature 32 has a structure where the recess part 32*f* is connected to the engagement part 32*b* and guide part 32*c*. Therefore, the engagement part 32*b* and guide part 32*c* can be supported by the part where the recess part 32*f* is formed. That is, the armature 32 has a structure where it is reinforced so as to suppress deformation of the engagement part 32*b* and guide part 32*c*. In particular, in the production of the armature 32, it is possible to suppress deformation of the engagement part 32*b* and the guide part 32*c* and possible to suppress the occurrence of defective products.

Figure 14:
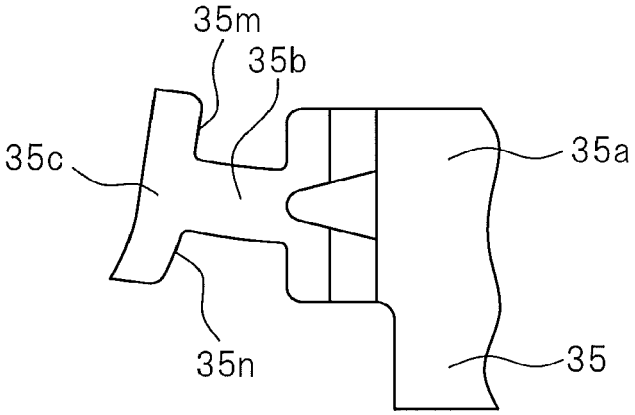
FIG. 14 is an enlarged plan view of an engagement part which explains defects in the armature of the comparative example.

FIG. 14 is an enlarged plan view of part of an engagement part 35*b* of an armature 35 of a comparative example. The armature 35 of the comparative example has a structure which does not have the recessed part 32*f* and where the engagement part 35*b* is not reinforced. For this reason, in the process of production of the armature 35, sometimes the engagement part 35*b* ends up deforming. Further, sometimes the guide part 35*c* ends up deforming. For example, in the process of washing a large number of armatures 35 at one time, sometimes the armatures 35 strike each other and, as shown in FIG. 14, the engagement parts 35*b* or the guide parts 35*c* end up bending. Alternatively, sometimes the engagement parts 35*b* or guide parts 35*c* end up being twisted. As opposed to this, the armature 32 of the present embodiment has a structure which is reinforced so as to suppress deformation of the part of the engagement part 32*b*, so deformation of the engagement part 32*b* and guide part 32*c* can be suppressed.

Figure 15:
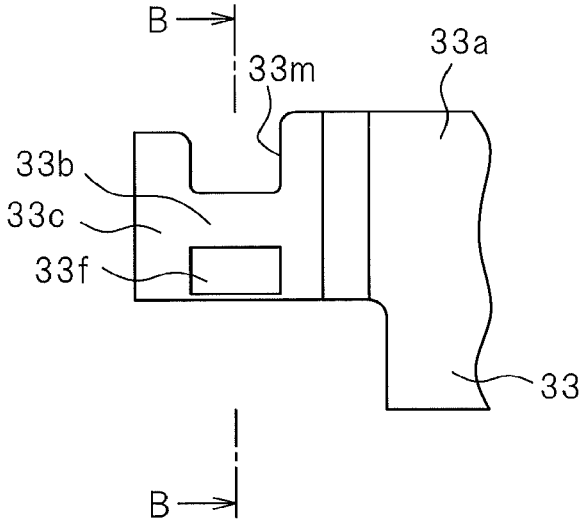
FIG. 15 is an enlarged plan view of a part of an engagement part of an armature according to a third example of the embodiment.
Figure 16:
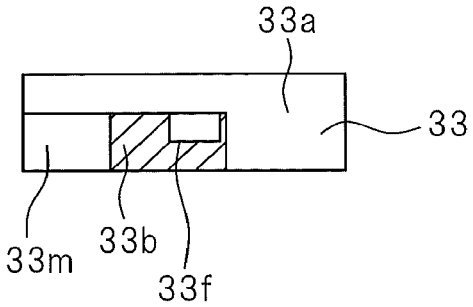
FIG. 16 is a cross-sectional view cutting a part of an engagement part of the armature according to the third example of the embodiment.

FIG. 15 is an enlarged plan view of part of the engagement part 33*b* of the armature 33 according to a third example of the present embodiment. FIG. 16 is a cross-sectional view of part of the engagement part 33*b* of the armature 33 according to the third example of the present embodiment. FIG. 16 is a cross-sectional view when cutting along the line B-B of FIG. 15. The armature 33 according to the third example includes an armature body 33*a*, engagement part 33*b*, and guide part 33*c*. The armature 33 is formed with a cutaway part 33*m* at one end in the width direction and is formed with a recess part 33*f* at the other end. The engagement part 33*b* is configured by the part which is sandwiched between the cutaway part 33*m* and the recess part 33*f*.

The recess part 33*f* of the armature 33 is formed with a rectangular cross-sectional shape. The ends of the engagement part 33*b* at the both sides in the width direction are structured without inclined parts. Even in an armature 33 which includes such an engagement part 33*b* and recess part 33*f*, deformation of the engagement part 33*b* and the guide part 33*c* in the process of production of the armature 33 can be suppressed. Therefore, defects in the armature 33 can be suppressed.

In the present embodiment, the card is made to move relative to the armature so as to fit the card in the engagement part of the armature, but the invention is not limited to this. It is also possible to make the armature move relative to the card so as to fit the card in the engagement part of the armature.

A chamfered part of the present embodiment is formed with a flat surface, but the invention is not limited to this. It may also be formed into a curved surface.

The electromagnetic relay of the present embodiment brings two contacts into contact with each other, but the invention is not limited to this. The present invention can also be applied to an electromagnetic relay which has three or more contacts and electrically connects, disconnects, or switches any contacts.

The above embodiments may be suitably combined. In the above figures, the same or corresponding parts are assigned the same reference notations. Note that the above embodiments are illustrations and do not limit the invention. Further, in the embodiments, changes which are shown in the claims are included.

The invention claimed is:

1. An electromagnetic relay comprising:

an electromagnet which includes a coil;

an armature which is pulled by said electromagnet;

a moving member which has a moving contact; and a connecting member which engages with said armature and said moving member and transmits an operation of said armature to said moving member; wherein said armature includes an armature body and an engagement part which engages with said connecting member, said connecting member includes a connecting member body, a pedestal part which extends from said connecting member body, a deforming part which extends from said connecting member body and can elastically deform, and a tab which is formed at the end of said deforming part and sticks out toward said pedestal part, said deforming part has a first part which extends from said connecting member body and a second part which extends bent from said first part and deforms when said engagement part is pushed between said pedestal part and said tab, said engagement part is sandwiched between said pedestal part and said second part when said engagement part engages with said connecting member, said engagement part has a surface facing in a width direction of said armature and a chamfered face along an edge of the surface, and the chamfered face contacts said tab and is positioned between said pedestal part and said tab when said engagement part is pushed between said pedestal part and said tab.

2. The electromagnetic relay as set forth in claim 1, wherein said armature has cutaway parts which are formed at the ends at the both sides in the width direction, and said engagement part is configured by a part which is sandwiched by said cutaway parts.

3. The electromagnetic relay as set forth in claim 1, wherein said armature includes a cutaway part which is formed at one end in the width direction and a recess part which is formed at the other end in the width direction, and said engagement part is configured by a part which is sandwiched by said cutaway part and said recess part.

4. An electromagnetic relay comprising:

an electromagnet which includes a coil;

an armature which is pulled by said electromagnet;

a moving member which has a moving contact; and a connecting member which engages with said armature and said moving member and transmits operation of said armature to said moving member; wherein said armature includes an armature body and an engagement part which engages with said connecting member, said connecting member includes a connecting member body, a pedestal part which extends from said connecting member body, a deforming part which extends from said connecting member body and can elastically deform, and a tab which is formed at the end of said deforming part and sticks out toward said pedestal part, said deforming part has a first part which extends from said connecting member body and a second part which extends bent from said first part and deforms when said engagement part is pushed between said pedestal part and said tab, and said engagement part is sandwiched between said pedestal part and said second part when said engagement part engages with said connecting member, and is configured by a part which is sandwiched between a cutaway part which is formed at one end of said armature in the width direction and a recess part which is formed at the other end in width direction.

* * * * *